US005935450A

United States Patent [19]

Benedict

[11] Patent Number: 5,935,450

[45] Date of Patent: Aug. 10, 1999

[54] POOL SKIMMER SCREENS

[76] Inventor: Charles E. Benedict, 3207 Remington Run, Tallahassee, Fla. 32312

[21] Appl. No.: 08/985,054

[22] Filed: Dec. 4, 1997

Related U.S. Application Data

[60] Provisional application No. 60/032,520, Dec. 5, 1996.

[51] Int. Cl.[6] ..... E04H 3/16

[52] U.S. Cl. ..... 210/776; 210/169; 210/232; 210/416.2; 210/460

[58] Field of Search ..... 210/169, 232, 210/416.2, 499, 460, 477, 154, 776, 473

[56] References Cited

U.S. PATENT DOCUMENTS

| | | | |
|---|---|---|---|
| 3,186,550 | 6/1965 | Beduhn . | |
| 3,268,079 | 8/1966 | Sharrow | 210/169 |
| 3,314,543 | 4/1967 | Nash | 210/169 |
| 3,372,809 | 3/1968 | Spitzer . | |
| 3,668,712 | 6/1972 | Baker | 4/510 |
| 3,767,055 | 10/1973 | Flatland . | |
| 3,918,107 | 11/1975 | Whitten, Jr. et al. . | |
| 4,140,634 | 2/1979 | Harry | 210/169 |
| 4,332,683 | 6/1982 | Alt | 210/499 |
| 4,421,644 | 12/1983 | Gedye | 210/233 |
| 4,426,286 | 1/1984 | Puckett et al. | 210/121 |
| 4,594,024 | 6/1986 | Jenkner et al. | 405/127 |
| 5,536,406 | 7/1996 | Silva | 210/460 |
| 5,672,271 | 9/1997 | Dye | 210/169 |
| 5,759,388 | 6/1998 | Cote | 210/169 |

*Primary Examiner*—Jay H. Woo
*Assistant Examiner*—Fred Prince
*Attorney, Agent, or Firm*—Dowell & Dowell, P.C.

[57] ABSTRACT

Screens for protecting the intake openings of pool skimmer systems which include a body portion having front and opposite side walls. Retention flanges extend from the body rearwardly relative to the front wall of the size to extend within the intake openings for retaining the screens within the intake openings. In some embodiments the screens may include top and/or bottom sections or an optional outwardly extending debris receiving tray.

18 Claims, 3 Drawing Sheets

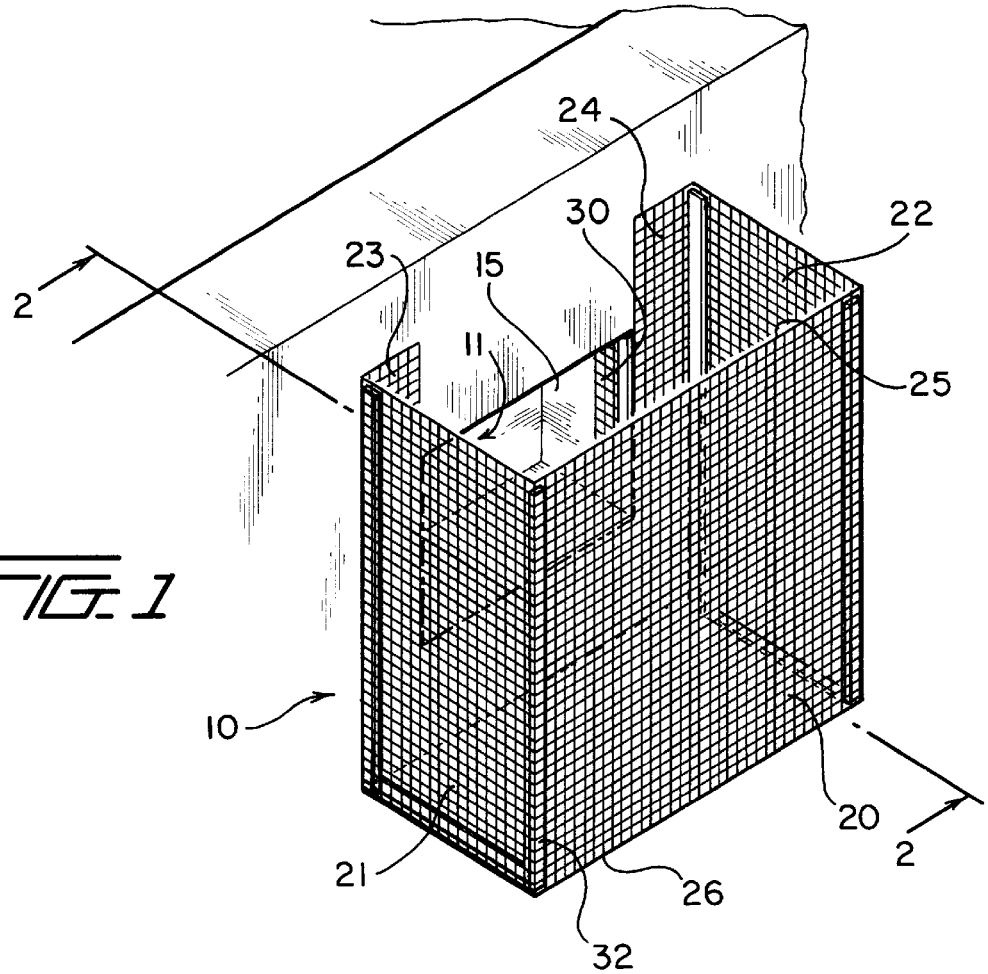
FIG. 1
FIG. 2
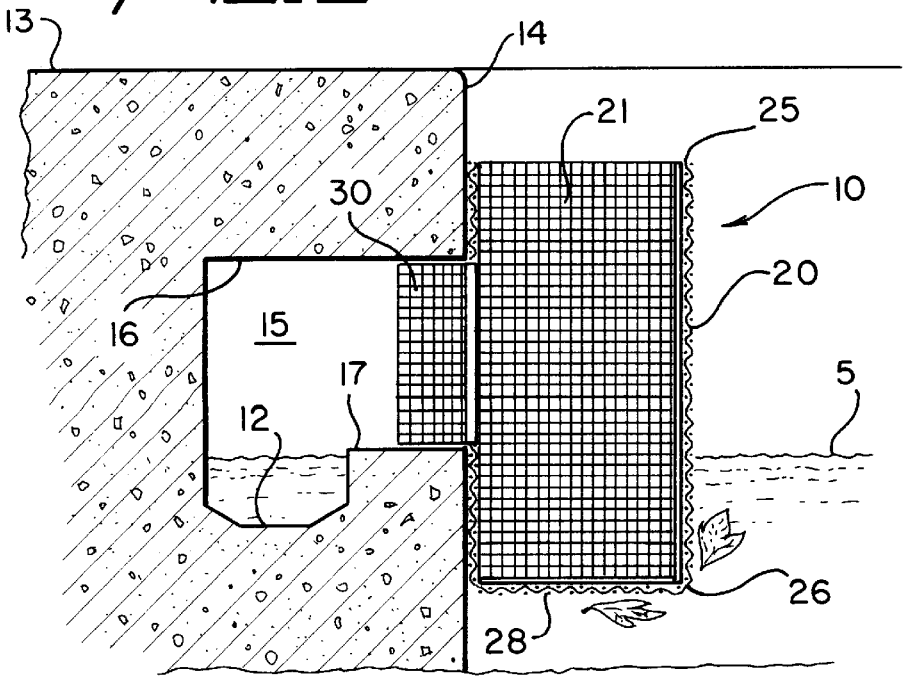

FIG. 6
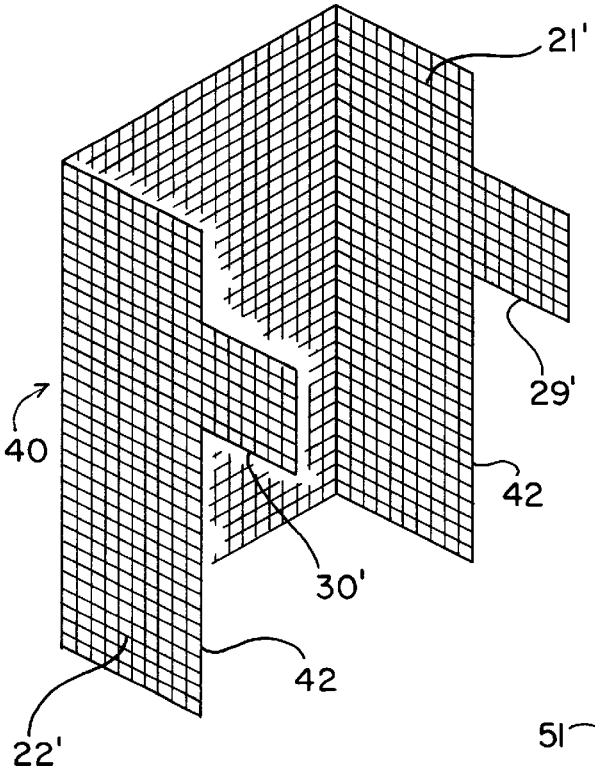
FIG. 7
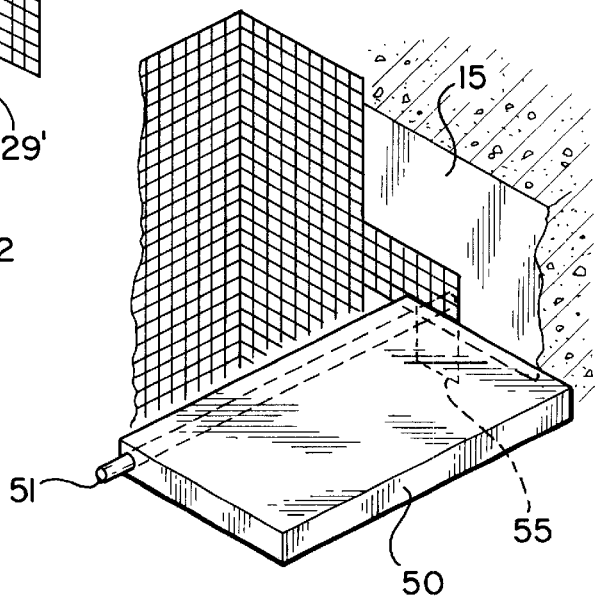
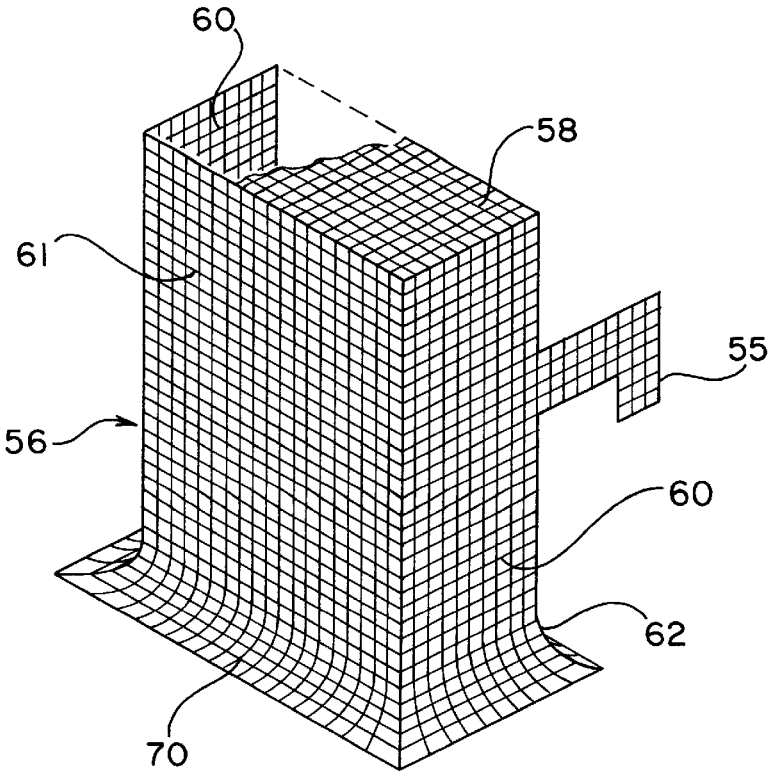
FIG. 8

POOL SKIMMER SCREENS

CROSS REFERENCE TO RELATED APPLICATION

This application is related to provisional application Ser. No. 60/032,520 filed on Dec. 5, 1996 entitled POOL SKIMMER SCREENS in the name of the same inventor.

BACKGROUND OF THE INVENTION

1. Field of the Invention

This invention is directed to screens designed to be supported within skimmer system intake openings which are formed in the side walls of a pool. The screens are designed to prevent floating debris from entering through the openings and into the pool filtration system.

2. History of the Related Art

The water in swimming and other pools must be continually filtered in order to assure safe water quality. Conventional pools utilize skimmer systems which include one or more filters which are spaced from the pools and which receive flow from the surface of the pools through skimmer openings provided along the side walls of the pools. Often, the openings into the skimmer systems are provided with rotatable flap valves which are used to regulate the amount of flow into the openings and may also include internal filtration baskets which are designed to remove larger materials but which must be cleaned often. Water flowing into the skimmer openings is conveyed by channels or troughs extending beneath the decks of pools to suitable filters. Once filtered, water is returned to the pools and introduced through nozzles provided through the side or bottom walls and which creates turbulence and current flow so that a continuous cleaning cycle may be achieved through the skimmer system.

It is often desired to maintain the water level in a pool during seasons of the year when debris falls into the water, such as during autumn season. Leaves, twigs and other debris are often conveyed into the skimmer system and clog the internal troughs and filters of the skimmer system thereby placing an increased load on the pumps which draw water to the filters and convey water back to the pool. Not only are leaves and other debris floating on the water surface drawn into the skimmer openings, but debris which has become soaked and which floats submerged beneath the water surface can also be drawn into the intake openings due to currents established beneath the surface of the water.

In U.S. Pat. No. 3,314,543 to Nash a pool skimmer system is disclosed which incorporates screen cages which are mounted beneath the deck of the pool in line with the skimmer openings and above the trough associated with the skimmer system. The cages are provided to prevent larger debris from entering into the trough and thus prevent such debris from entering the filters. Unfortunately, the cages are placed within the intake openings where they are hard to access and are often not properly maintained due to their obscurity.

In U.S. Pat. No. 4,140,634 to Harry, a swimming pool skimmer shield is disclosed which is designed to be mounted to the side walls of a pool so as to be suspended in covering relationship with respect to the openings in the skimmer system. The patent discloses the use of hooks or fasteners which are driven into the side walls of the poll on opposite sides of the skimmer openings. Thereafter a porous shield is suspended so as to extend across the full width of a skimmer intake opening to block debris from entering the opening.

Unfortunately, the structure disclosed in this patent requires that fasteners be utilized to secure the shields to the side wall of the pool. It is not practical nor desirable to compromise the integrity of the side walls of the pool by driving fasteners into the walls adjacent the intake openings. The use of such fasteners can create maintenance problems and further, the fasteners may easily be dislodged leaving holes in the side walls of the pool. The also discloses the use of suction cup type supports, however, the use of suction cups in a pool environment to retain a shield to the side wall of the pool would not be functional as the shield could be easily dislodged from a position in covering relationship with respect to a skimmer intake opening.

In view of the foregoing, there remains a need to provide an effective device for preventing debris from entering the intake openings into a pool filtration or skimmer system.

SUMMARY OF THE INVENTION

The present invention is directed to screen devices for preventing debris from entering the intake opening of pool filtration or skimmer systems. The devices include porous bodies of a size to extend in covering relationship to opposite sides of an intake opening into the skimmer system. Each body has an upper and lower edge portion and the lower edge portion is designed to extend below the level of the intake openings into the skimmer system. The devices further include retention flange elements which extend rearwardly with respect to the front of the bodies and which are of the size to enter the intake openings. In a first embodiment, the retention elements are designed to frictionally engage either opposing side walls and/or upper and lower walls defining an intake opening to thereby frictionally retain the devices relative to the intake openings.

In a further embodiment of the present invention, the retention flange elements are designed to hook about a pivot shaft associated with a flap valve mounted within an intake opening and thereby suspend the devices from the pivot shaft.

In the preferred embodiments, the devices of the present invention are formed of an open mesh material so as to allow minimum resistance to fluid flow therethrough and yet provide for maximum retention of debris.

In some embodiments of the present invention, the devices are designed to be constructed in a generally flat configuration and thereafter, the side, front walls and retention members folded into proper orientation for use, thus allowing for compact storage and shipment.

In another embodiment of the present invention, the devices may be provided with upper and/or lower screens to further prevent debris from entering through the upper or lower portion of the devices when in use. In a further embodiment, an outwardly extending tray may be provided which extends from the body portion outwardly away from the intake opening. The tray serves to gather debris which settles within the water of a pool adjacent to the intake opening.

It is the primary object of the present invention to provide screening devices for preventing debris from entering the intake openings of pool skimmer or filtration systems wherein the devices may be placed into use without any alteration to the existing pool or skimmer structure thus preserving the integrity of the pool structure.

It is also an object of the present invention to provide screening devices for use in preventing debris from entering the intake openings of skimmer systems associated with pools wherein the devices may be made of a low cost material and wherein the devices may be placed into use without the use of tools and supplemental fasteners.

It is yet another object of the present invention to provide an economic and efficient method of preventing debris from entering into the intake openings of pool filter or skimmer systems wherein the maintenancing of the devices may be accomplished from the deck of the pool and wherein the requirement for cleaning of the devices to remove filtered debris will be visually apparent to a pool operator.

BRIEF DESCRIPTION OF THE DRAWINGS

FIG. 1 is a perspective illustrational view of a first embodiment of the invention shown mounted within the intake opening into the skimmer system associated with a pool;

FIG. 2 is a partial cross-sectional right side view taken along line 2—2 of FIG. 1;

FIG. 6 is a rear perspective view of another embodiment of the present invention;

FIG. 7 is a partial illustrational view of another embodiment of the present invention showing the skimmer screen being mounted to a pivot associated with a flapper mounted in the intake opening of a pool skimmer system; and FIG. 8 is a front perspective view of yet another embodiment of the present invention incorporating an upper mesh cover and a lower outwardly extending debris retention tray.

DESCRIPTION OF THE PREFERRED EMBODIMENTS

Figure 3:
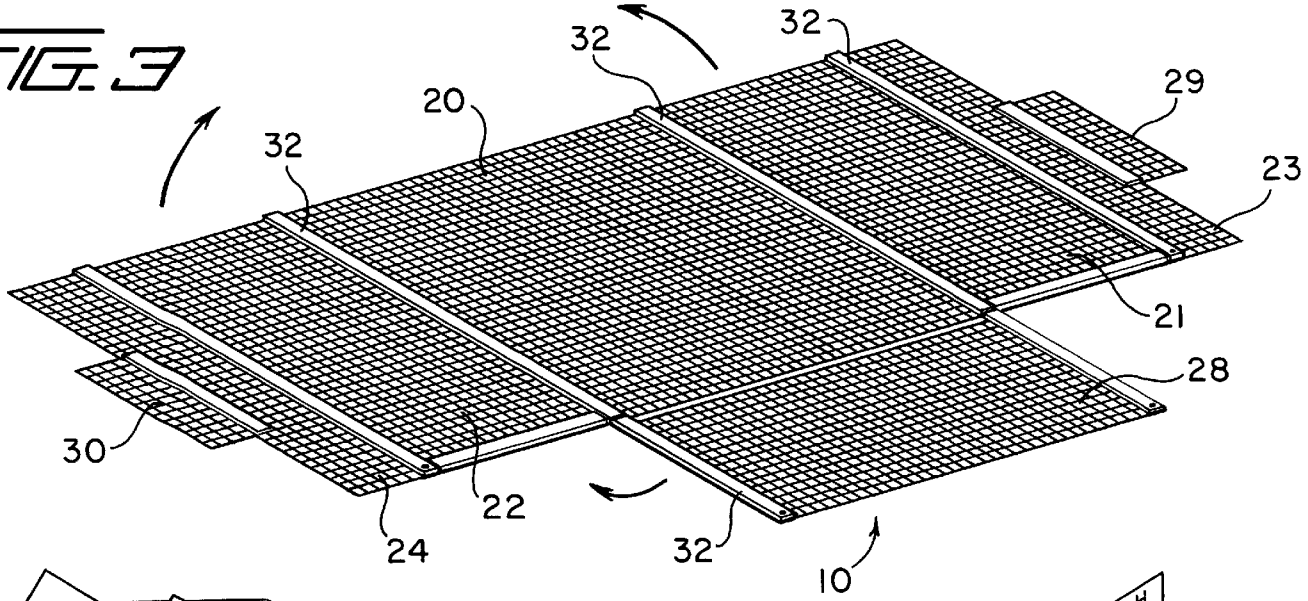
FIG. 3 is a top perspective view of the screen shown in FIG. 1 before the screen is folded to the configuration of FIG. 1.
Figure 4:
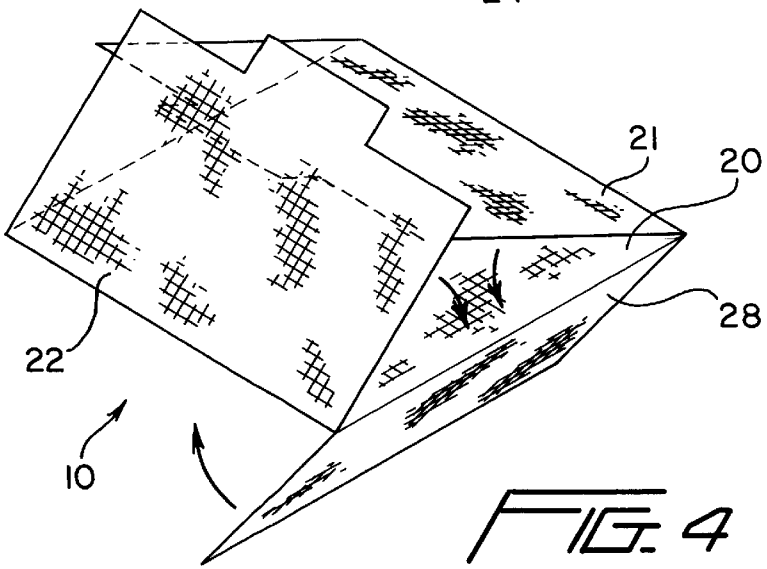
FIG. 4 is a perspective illustrational view of the embodiment of FIG. 3 showing the screen being folded into a compact configuration for shipment and sale.

With continued reference to the drawing figures, the pool skimmer screens 10 of the present invention are designed to be mounted within intake openings 11 associated with a pool skimmer system. The skimmer system includes a water conveying channel or trough 12 which is formed below the deck 13 of the pool interiorly of the side walls 14 thereof. The intake openings 11 are defined by opposing side walls 15 and opposing upper and lower walls 16 and 17.

The surface of the water "S" within the pool is normally maintained above the lower wall 17 of the intake openings so that water flows into the trough 12 to a filtration apparatus (not shown). Thereafter, the water is pumped back into the pool through nozzles (not shown) in the bottom or side walls of the pool.

With particular reference to FIGS. 1 through 4, a first embodiment of the present invention is disclosed. In this embodiment, the skimmer screen 10 includes a front open mesh wall 20, opposing open mesh side walls 21 and 22, and vertically extending rear wall sections 23 and 24 which are designed to abut the side wall 14 of the pool. The skimmer screen includes an uppermost edge 25 which extends above the upper wall 16 of the skimmer intake opening 11. The upper edge is sufficiently elevated to prevent any debris from being drawn into the intake opening. Further, the skimmer screen 10 includes a lower edge 26 which extends below the lower wall 17 of the intake opening 11. Although not essential, especially if the lower edge is located at a significant distance below the lower wall 17 of the intake opening, the skimmer screen 10 may include a lower or bottom wall 28. The lower wall will prevent debris which has lost buoyancy, and which floats below the surface of the water, from being drawn upwardly and into the intake opening 11.

To mount the skimmer screen 10 within the intake opening 11, a pair of mounting flanges 29 and 30 extend rearwardly from the rear wall sections 23 and 24. The flanges are shown extending rearwardly intermediate the upper and lower edges of the screen but, in some instances, may extend from adjacent the upper edge thereof. The mounting flanges 29 and 30 are of a height substantially equal to the height of the intake opening as measured between the upper and lower walls 16 and 17 and are spaced from one another such that when the mounting flanges are inserted within the opening 11, the flanges will be frictionally engaged either against the side walls 15 or upper and lower walls 16 and 17, or both. In this manner, the screens are secured in place without requiring alterations to the exterior surface of the wall 14 of the pool or the walls of the intake opening. Although not shown in the drawing figures, as opposed to having vertical mounting flanges 29 and 30, it is possible that the flanges could be designed to extend horizontally, thereby engaging the upper and lower walls 16 and 17 defining the intake opening 11 into the skimmer system. In some embodiments, although not preferred, a single vertical or horizontal flange may be utilized to support the screen within the intake opening provided that sufficient structure is provided to prevent twisting of the screen when placed within the intake opening.

The screen shown in FIGS. 1 through 4 is generally rectangular or U-shaped in cross-section. However, other configurations may be used. For example, the side and front walls may form a continuous curved surface, V-shaped or the like. It is preferred, however, to provide sufficient screen surface surrounding the intake opening to prevent the total obstruction of the screen which would block water flow into the skimmer system.

The screens may be formed of a metal wire mesh material which may be coated to prevent rust or, in the alternative, may be formed of a fabric or plastic mesh material which is mounted to frame components, as shown in the drawing figures. The frame components include wire or heavy plastic rods 32 which are assembled into a box-like configuration, as shown in FIGS. 1 and 2. Preferably, the frame components 30 are joined to one another in such a manner that each of the side, front and rear wall portions may be folded upon one another, as shown by example in FIG. 4, so that the screen may be shipped and stored in a compact flat configuration. As opposed to using frame components, the screen may be folded from flat metal wire mesh materials which are sufficiently rigid so as to make the screen self-supporting.

Figure 5:
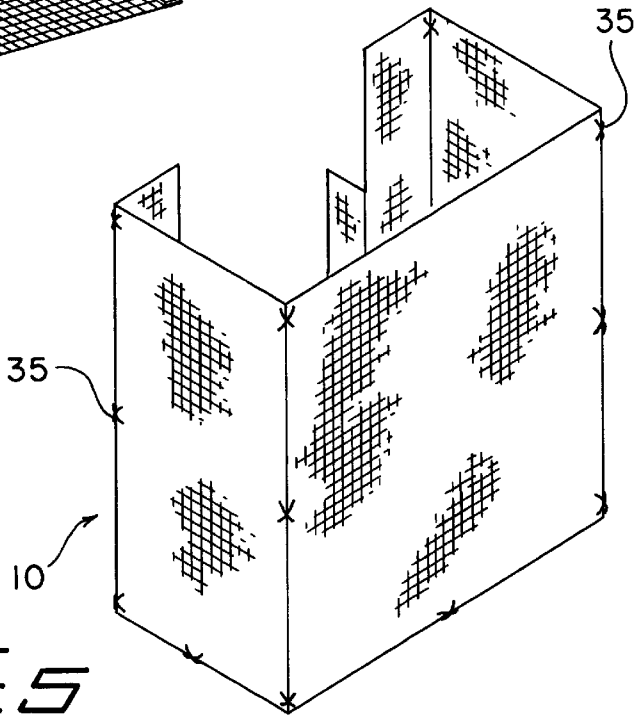
FIG. 5 is another embodiment of the present invention showing the components of the skimmer screen assembled using wire ties.

In FIG. 5, separate wire ties 35 are shown as joining each of the front, side and rear wall frame components of the skimmer screen in such a manner that the screen elements may be pivoted relative to one another and folded from a flat to an erect configuration.

With reference to FIG. 6, another embodiment of screen 40 is shown in greater detail. In this embodiment, as opposed to having the rear wall segments 23 and 24, the mounting flanges 29' and 30' are shown as extending directly from the side walls 21' and 22'. In this embodiment, the mounting flanges or retention tabs are designed to be frictionally retained between the upper and lower walls 16 and 17 defining the skimmer opening in a manner similar to that discussed with respect to the previous embodiments. The innermost edges 42 of the main portion of the side walls 21' and 22' are engageable against the side wall 14 of the pool with the side walls extending above and below the skimmer opening, as previously discussed. A lower screen is not shown, however, a lower screen and/or an upper screen forming a top for the unit may be provided.

With respect to FIG. 7, a modification of the embodiment shown in FIG. 6 is disclosed. In many skimmer systems, flap valves 50 are provided within the intake openings which are mounted on pivot rods 51 which support the valves within the openings. In this embodiment, as opposed to frictionally mounting the screens within the intake openings, the retention tabs or mounting flanges are provided with hooked end portions 55 which are designed to engage the pivot rods on either side of the flap valve and between the flap valve and the side walls 15 defining the intake opening. This type of retention system prevents the screens from being accidentally pulled from the intake openings as the hooked ends will be securely retained by the pivot rods associated with the flap valves.

The flanges or retention tabs need not be formed of an open mesh material, but may be formed of any material which is sufficiently rigid and which is sufficiently secured to the side walls to support the screens relative to the intake openings.

With respect to FIG. 8, a further embodiment of screen 56 is shown which includes the hooked mounting flanges 55 shown in FIG. 7, however, the screen 56 may include mounting flanges as shown in FIGS. 1 through 4 and 6. In this embodiment, an optional upper cover 58 is provided which may either be fixedly secured to the opposing side walls 60 and front wall 61 of the screen or may be pivotally attached thereto so as to permit the unit to be folded into a compact configuration, as previously discussed with respect to FIG. 4. As with the previous embodiments, this type of unit may include side walls which are pivotally secured to the front wall or which are bent from a single sheet of material so that the corners are somewhat rigid.

In addition to the foregoing, the embodiment of FIG. 8 shows an optional horizontal tray 70 which extends outwardly from the lower edge 62 of the screen from the opposite side walls and front wall. The tray may be attached by separate hooks (not shown) or may be integrally formed with the screen 56. The screen tray is generally concave along its upper surface so as to function as a cradle for receiving debris which settles within the pool. In this manner, the screen may be removed from engagement within the intake opening and lifted so as to recover debris retained within the tray. It is preferred that the tray be formed of an open mesh material which may be the same material utilized to form the front and side walls of the screen.

It should also be noted that open mesh material is not the only material which may be utilized within the teachings of the present invention. Various other types of perforated panels can be used, including those having slotted openings or multiple perforations. However, it is desirable not to interrupt the normal flow characteristics of the water relative to the skimmer system and therefore the open mesh materials are preferred.

Although not specifically shown in the drawing figures, it is possible that the screens of the present invention may be utilized without the side walls such as shown at 21, 22, 21', 22' and 60 with the mounting or retention flanges 29, 30, 29', 30' and 53 extending directly from the front wall of the screens. In such embodiments, the front walls would be substantially flush with the intake opening, however, would be retained by the mounting or retention flanges in a manner as previously described. This particular embodiment is not preferred in that it reduces the effective surface area of the screen device when in use and thus would become clogged more quickly requiring the screens to be cleaned more often in order to assure proper flow of water into the intake openings of the skimmer system.

One of the unique benefits of the present invention is the screens may be deployed from the deck of a pool without an individual having to access the water and without having to make any alterations or modifications to the integrity of the pool. Further, when a screen becomes clogged due to debris collecting against the body of the screen during use, it will be apparent from a quick visual inspection of the pool perimeter and thus cleaning of clogged screens may be assured thus preventing the chance of low fluid flow to the pumps associated with a pool skimmer system.

The foregoing description of the preferred embodiment of the invention has been presented to illustrate the principles of the invention and not to limit the invention to the particular embodiment illustrated.

What is claimed is:

1. A device for preventing floating debris from entering an intake opening associated with a skimmer system of a pool, wherein the intake opening is provided in a side wall of a pool and is defined by opposing side walls and upper and lower walls, the device comprising, a screen means having a porous body including an upper edge, a lower edge and spaced side edges, said body being configured such that when said side edges are in engagement against the side wall of a pool said body extends outwardly from the side wall of the pool in covering relationship to the intake opening, at least one mounting flange element extending rearwardly from said body, said at least one mounting flange element being of a size to be cooperatively received within the intake opening to thereby support said body relative thereto with said lower edge of said body adapted to extend below the lower wall of the intake opening, whereby debris floating on water in the pool is prevented from entering the skimmer intake opening.

2. The device of claim 1 including a pair of spaced mounting flange elements and said mounting flange elements being spaced intermediate said upper and lower edges of said body.

3. The device of claim 2 in which each of said spaced mounting flange elements includes a hook portion.

4. The device of claim 1 including a pair of spaced mounting flanges, said mounting flanges being configured so as to be adapted to frictionally engage the upper and lower walls of the intake opening.

5. The device of claim 1 including a pair of spaced mounting flanges, said mounting flanges being configured so as to be adapted to frictionally engage the side walls of the skimmer opening.

6. The device of claim 1 including a pair of spaced mounting flanges, each of said mounting flanges including a hook portion adapted to engage a rod mounted within the intake opening.

7. The device of claim 1 wherein the body includes opposing sides and a front wall, a top extending between said opposing side and front wall thereof.

8. The device of claim 1 in which said body is generally U-shaped in configuration having a front wall and opposing side walls.

9. The device of claim 8 including means for pivotally connecting said side walls to said front wall.

10. The device of claim 8 including a bottom wall mounted between said side walls and said front wall.

11. The device of claim 1 further including tray means extending outwardly adjacent said lower edges of said body for collecting debris suspended within the water of a pool.

12. A device for preventing floating debris from entering an intake opening associated with a skimmer system of a pool, wherein the intake opening is provided in a side wall of a pool and defined by opposing side walls and upper and lower walls, the device comprising, a screen means having a porous body including an upper edge, a lower edge and spaced side edges, said body being of a size to be positioned in engagement against the side wall of a pool in covering relationship to an intake opening, mounting flange means extending rearwardly from said body, said mounting flange means being of a size to be received within the intake opening to thereby support said body relative thereto with said lower edge of said body adapted to extend below the lower wall of the intake opening, whereby debris floating on water in the pool is prevented from entering the skimmer intake openings.

13. The device of claim 12 wherein said mounting flange means includes at least two spaced flanges of a size and configuration to frictionally retain said body within the intake opening.

14. The device of claim 12 wherein said mounting flange means includes at least two spaced flanges having hooked portions for engaging a rod mounted within the intake opening.

15. A method for preventing floating debris from entering an intake opening associated with a skimmer system of a pool, wherein the intake opening is provided in a side wall of a pool and is defined by opposing side walls and upper and lower walls, the method comprising the steps of:

a) providing a porous material device through which water can flow and from which extends extension elements of a size to be insertable within the intake opening of the pool;

b) inserting the extension elements within the intake opening of the pool so as to frictionally engage within the intake opening to thereby retain the device outwardly of the intake opening.

16. The method of claim 15, including additional steps of:

a) periodically removing the extension elements of the device from the intake opening by pulling the device outwardly relative to the intake opening;

b) removing debris from the device; and c) reinserting the extension elements of the device into the intake openings so as to frictionally retain the device outwardly of the intake opening.

17. A method for preventing flowing debris from entering an intake opening associated with a skimmer system of a pool, wherein the intake opening is provided in a side wall of a pool and is defined by opposing side walls and upper and lower walls and wherein a rod is provided within the intake opening, the method comprising the steps of:

a) providing a porous material device through which water can flow and from which extends extension elements of a size to be insertable within the intake opening of the pool;

b) inserting the extension elements within the intake opening of the pool so as to be engaged by and be retained by the rod to thereby support the device relative to the intake opening.

18. The method of claim 17, including additional steps of:

a) periodically removing the device relative to the intake opening by lifting the extensive elements free of the rod and pulling the device outwardly relative to the intake opening;

b) removing debris from the device; and c) reinserting the extension elements of the device into the intake openings so as to be retained by the rod within the intake opening.

* * * * *